US010225648B1

(12) United States Patent
Voishvillo et al.

(10) Patent No.: US 10,225,648 B1
(45) Date of Patent: Mar. 5, 2019

(54) HORN ARRAY

(71) Applicant: Harman International Industries, Incorporated, Stamford, CT (US)

(72) Inventors: Alexander Voishvillo, Simi Valley, CA (US); Alex Pliner, Van Nuys, CA (US); Toni Lilienthal, Northridge, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/873,772

(22) Filed: Jan. 17, 2018

(51) Int. Cl.

| | |
|---|---|
| ***H04R 1/34*** | (2006.01) |
| ***H04R 1/40*** | (2006.01) |
| ***H04R 3/12*** | (2006.01) |
| ***H04R 5/02*** | (2006.01) |

(52) U.S. Cl.
CPC ..... *H04R 1/345* (2013.01); *H04R 1/403* (2013.01); *H04R 3/12* (2013.01); *H04R 5/02* (2013.01); *H04R 2201/401* (2013.01)

(58) Field of Classification Search
CPC ..... G10K 11/22; G10K 11/26; H04R 1/30; H04R 1/345; H04R 1/403; H04R 3/12; H04R 5/02; H04R 27/00; H04R 2201/34; H04R 2201/401
See application file for complete search history.

(56) References Cited

U.S. PATENT DOCUMENTS 4,845,759 A * 7/1989 Danley ..... G10K 11/025 181/187
6,394,223 B1 * 5/2002 Lehman ..... H04R 1/345 181/152
9,111,521 B2 8/2015 Blore et al.
2011/0268305 A1 * 11/2011 Buccafusca ..... G10K 11/025 381/340
2015/0000998 A1 * 1/2015 McKinnon ..... G10K 11/26 181/192
2015/0289050 A1 * 10/2015 Butler ..... G10K 11/22 381/387
2015/0358734 A1 * 12/2015 Butler ..... H04R 3/12 381/59

OTHER PUBLICATIONS

Beranek, L., "Acoustics," Acoustical Society of America, Originally Published 1954,1993 Edition, Available as Early as Jan. 1, 1993, 255 pages.

* cited by examiner

*Primary Examiner* — Mark Fischer
(74) *Attorney, Agent, or Firm* — McCoy Russell LLP

(57) ABSTRACT

Embodiments are disclosed for loudspeaker arrays that maximize a number of transducers and associated channel waveguides for a given length of the arrays. In one example, a loudspeaker array includes a plurality of transducers arranged in adjacent groups on opposing sides of a vertical axis of the loudspeaker array, and a plurality of channel waveguides, each channel waveguide coupled to a different transducer of the plurality of transducers, outlets of each channel waveguide being center aligned with one another along the vertical axis of the loudspeaker array. In the example, at least two inlets of the plurality of channel waveguides are substantially aligned along a horizontal plane, the horizontal plane being perpendicular to the vertical axis.

20 Claims, 14 Drawing Sheets

HORN ARRAY

FIELD

The disclosure relates to array configurations for transducers and associated waveguides for a loudspeaker.

BACKGROUND

Array loudspeaker systems may include multiple transducers (direct radiating, horn-loaded, or both). Typically, arrays have wide horizontal directivity pattern and much narrower directivity in the vertical plane. Directivity in the horizontal plane is determined by either a width of the array or the use of an additional waveguide. In the vertical plane, the directivity can be varied to provide sound signal coverage of certain listening areas. A vertical directivity pattern of an array may be provided by a geometrical shape of the array and/or by applying particular amplitude and phase distributions to each element of the array or to a group of elements (e.g., delay between transducers). For example, J-shaped line arrays may provide narrower vertical directivity for a long-distance listening area and a wider coverage for the nearfield area. In other arrays, a selected directivity may be provided by amplitude-phase distribution of the signal across the elements of the array (e.g., the transducers) while the array remains straight.

SUMMARY

At high frequencies where a wavelength of a radiated signal is comparable to the size of each individual element (e.g., radiator, electroacoustic transducer) of an array and to the distance between the elements, directivity of the array exhibits additional multiple lobes. In an idealized model, the far-field vertical directivity of an array consisting of n elements with the vertical dimension h and the distance between adjacent elements d is a product of directivities of the array and the individual elements:

$$p = A\left|\frac{\sin\left[\left(\frac{n\pi d}{\lambda}\right)\sin\Theta\right]}{n\sin\left[\left(\frac{n\pi d}{\lambda}\right)\right]}\right|\left|\frac{\sin\left[\left(\frac{\pi h}{\lambda}\right)\sin\Theta\right]}{\left(\frac{\pi h}{\lambda}\right)\sin\Theta}\right|,$$

where $\Theta$ is the angle to the axis of the array, $$\lambda = \frac{2\pi f}{c}$$

is wavelength, f is frequency, and c is the speed of sound.

Increasing the number of radiating elements per length while decreasing the size and spacing of the elements (e.g., minimizing a height of the array) may result in better control of a high-frequency directivity of the array and may lower the spatial granularity in the directivity of the array. Approaches to increase the number of radiating elements per length may include placing radiating elements in a staggered arrangement or dramatically bending waveguides of the radiating elements to position the elements in different planes. However, a staggered arrangement may not truly maximize the number of radiating elements per length, as the elements may only partially overlap one another in a horizontal dimension. Dramatically bending waveguides of the radiating elements (e.g., to nearly 90 degrees) may cause reflections that produce severe irregularity of frequency response.

The present disclosure provides configurations of transducers and waveguides in an array that provide a more compact package than the above-described approaches, as well as a curved waveguide that minimizes bending and resulting reflections relative to the dramatically bent approach described above. For example, a more compact position of transducers is made possible by a particular waveguide shape which is curved in a vertical plane and directed at a symmetric angle to a horizontal axis of the array. The position of each pair of adjacent transducers are arranged in such a way that the transducers are aligned horizontally, and the exits of the corresponding waveguides for the transducers are aligned vertically.

Embodiments are disclosed for loudspeaker arrays that maximize a number of transducers and associated channel waveguides for a given length of the arrays. In one example, a loudspeaker array includes a plurality of transducers arranged in adjacent groups on opposing sides of a vertical axis of the loudspeaker array, and a plurality of channel waveguides, each channel waveguide coupled to a different transducer of the plurality of transducers, outlets (e.g., outputs/exits) of each channel waveguide being center aligned with one another along the vertical axis of the loudspeaker array. In the example, at least two inlets (e.g., inputs) of the plurality of channel waveguides are substantially aligned along a horizontal plane, the horizontal plane being perpendicular to the vertical axis.

In another example, a loudspeaker array includes a plurality of transducers including a first group of transducers positioned on a first side of a projection plane of the loudspeaker array and a second group of transducers positioned on a second, opposing side of the projection plane, the projection plane including a vertical axis of the loudspeaker array, a plurality of curved channel waveguides, each channel waveguide coupled to a different transducer of the plurality of transducers at an inlet of the channel waveguide, an outlet of each channel waveguide having a center positioned on the projection plane of the loudspeaker array, and an outer waveguide coupled to the outlets of the plurality of channel waveguides. In this example, each inlet of each channel waveguide of the plurality of channel waveguides that is coupled to a transducer in the first group of transducers is substantially aligned along a horizontal plane with the inlet of an associated channel waveguide of the plurality of channel waveguides that is coupled to a transducer in the second group of transducers, the horizontal plane being perpendicular to the projection plane and the vertical axis.

Another example loudspeaker array includes a plurality of transducers arranged in adjacent groups on opposing sides of a vertical axis of the loudspeaker array, and a plurality of channel waveguides, each channel waveguide coupled to a different transducer of the plurality of transducers and each channel waveguide having a length along which sound produced by an associated transducer of the plurality of transducers travels, an outlet of each channel waveguide being center aligned along the vertical axis of the loudspeaker array. In this example, each channel waveguide of the plurality of channel waveguides is contoured along the length symmetrically to complement a contour of an associated channel waveguide on an opposite side of the vertical axis of the loudspeaker array.

BRIEF DESCRIPTION OF THE DRAWINGS

The disclosure may be better understood from reading the following description of non-limiting embodiments, with reference to the attached drawings, wherein below.

DETAILED DESCRIPTION

As described above, control over vertical directivity of sound generated by a loudspeaker array increases with the number of sound wave-producing elements (e.g., transducers, compression drivers) in the array. The present disclosure provides example arrangements of transducers and waveguides in a loudspeaker array that maximize the number of transducers in the array.

Figure 1:
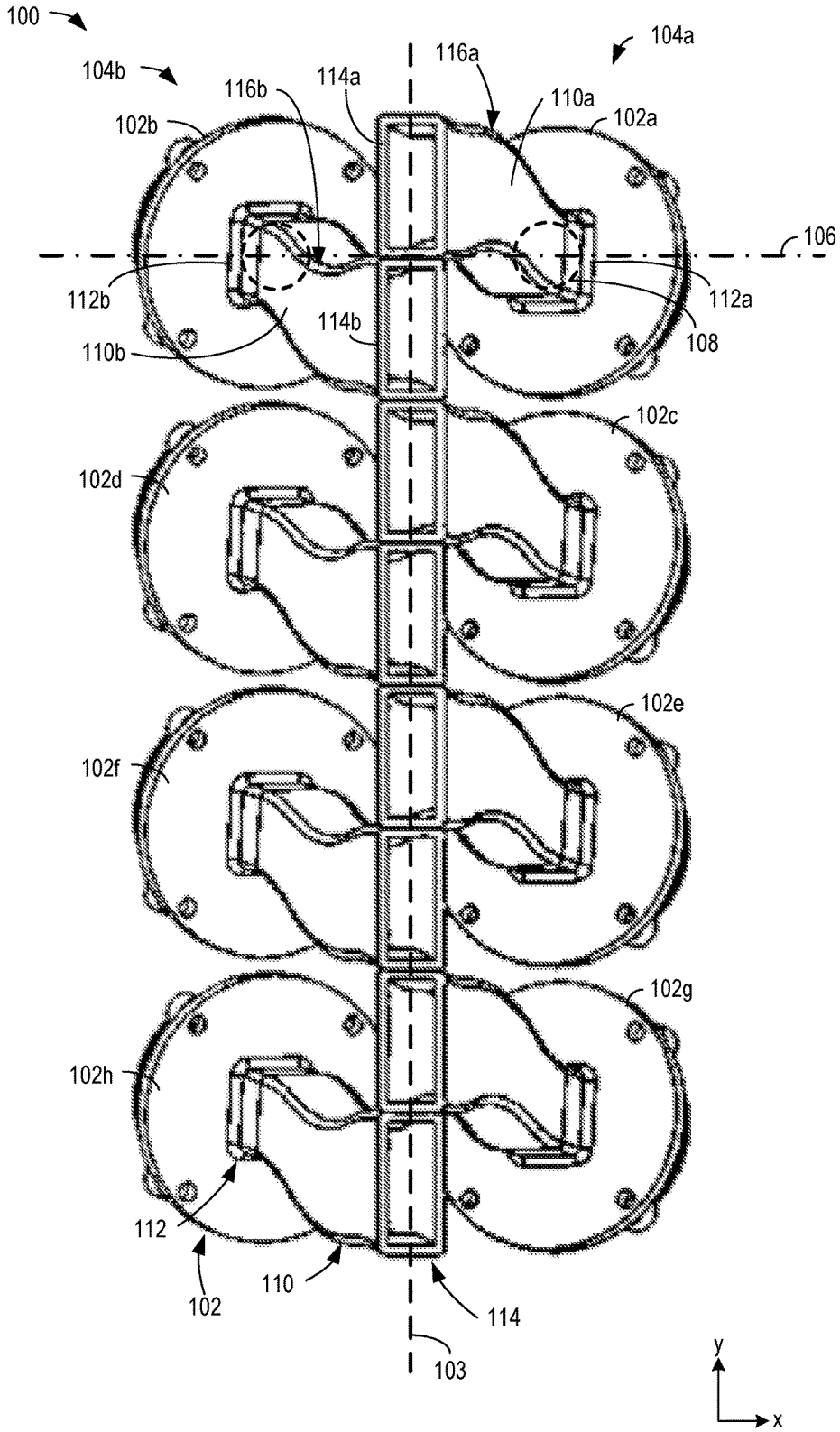
FIG. 1 shows a front view of a first example of an array of transducers in accordance with one or more embodiments of the present disclosure.
Figure 5:
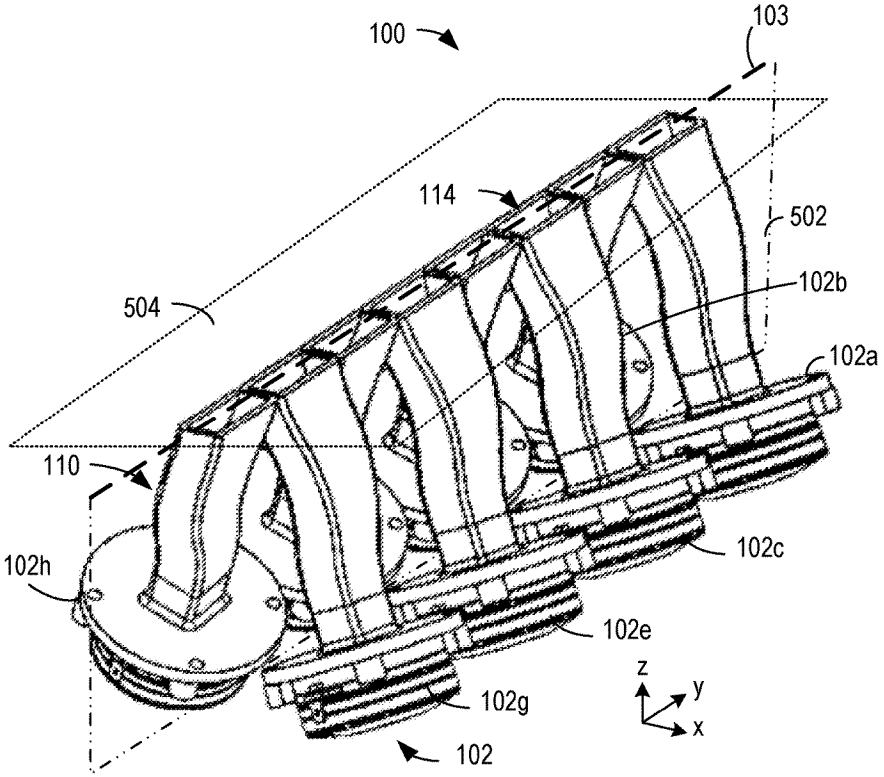
FIG. 5 shows an isometric view of the first example of the array of transducers in accordance with one or more embodiments of the present disclosure.

FIGS. 1-5 show different views of an example loudspeaker array. For example, FIG. 1 shows a front view of an example array 100 of transducers 102 configured to produce sound in a loudspeaker. Each transducer may be configured to generate sound pressure waves that may be perceived as audible sound by listeners. In one example, each transducer may include a high frequency compression driver. As shown, the transducers 102 are arranged in adjacent groups on opposing sides of vertical axis 103 (and on opposing sides of a projection plane including vertical axis—the projection plane is illustrated in FIG. 5 for clarity). The vertical axis 103 may be aligned with a longitudinal axis and/or in a "y" direction in a Cartesian coordinate system. For example, a first bank 104*a* may include a first group of transducers 102*a*, 102*c*, 102*e*, and 102*g* and a second bank 104*b* may include a second group of transducers 102*b*, 102*d*, 102*f*, and 102*h*. Accordingly, the array 100 is arranged such that pairs of transducers are each aligned (e.g., center aligned, as will be described in more detail below) along a horizontal axis, such as horizontal axis 106 (or another horizontal axis parallel to horizontal axis 106). The horizontal axes may extend in an "x" direction in the Cartesian coordinate system.

In order to reduce redundancy in the disclosure, features of a first transducer, 102*a*, and a second transducer, 102*b*, will be described in detail. It is to be understood that features described for an example transducer (e.g., transducer 102*a*) may apply to all of the transducers of array 100 and/or to each transducer in the same vertical column (e.g., the same bank or group of transducers) as the example transducer (e.g., each transducer below transducer 102*a* and in bank 104*a* in the configuration orientation illustrated in FIG. 1). Likewise, features described for an example pair of adjacent transducers (e.g., transducers 102*a* and 102*b*) may apply to each pair of adjacent transducers of array 100 (e.g., each pair of adjacent transducers below transducers 102*a* and 102*b* in the configuration orientation illustrated in FIG. 1). Additionally, the illustrated example of array 100 includes eight transducers. In other examples, more or fewer transducers may be included in the array without departing from the scope of this disclosure.

Transducer 102*a* is configured to output generated sound waves at exit 108 (e.g., a radiating end of the transducer represented by a dashed-line circle since a view of the exit is blocked by channel waveguide 110*a*, described below), which may have a circular shape. Exit 108 is positioned at an inlet 112*a* to the channel waveguide 110*a*. Each channel waveguide 110 in the array 100 is coupled to a different transducer. As shown, an exterior of the inlet 112*a* to the channel waveguide may have an approximately square or rectangular shape. In some examples, an interior of the inlet 112*a* may have a similar or same square or rectangular shape as the exterior of the inlet. In other examples, an interior of the inlet 112*a* may have a circular shape that has at least the same diameter as the exit 108 of the transducer. In either example, the channel waveguide 110*a* is sized and positioned to receive the generated sound waves output by the transducer 102*a* at exit 108 and transmit the generated sound waves through an interior volume of the channel waveguide 110*a* to an outlet 114*a* of the channel waveguide. As shown, outlet 114*a* is rectangular in shape. In other examples, outlet 114*a* may be circular (e.g., with dimensions that are a function of the dimensions of exit 108 and/or inlet 112*a*) or another suitable shape. The outlet 114*a* may be sized and shaped to provide a desired sound profile for the sound generated by transducer 102*a*.

In the example of FIG. 1, the outlets 114 of each channel waveguide 110 are center aligned with one another along the vertical axis 103 of the array. In this way, the centers of the outlets 114 (and a central vertical axis of the outlets in the "y" direction) are positioned on the vertical axis 103 and/or on a projection plane aligned with and/or including the vertical axis 103 (e.g., extending from the vertical axis 103 in a "z" direction that is perpendicular to the "x" and "y" directions). In some examples, adjacent outlets of the array may be in direct, face-sharing contact with one another (e.g., a bottom surface of outlet 114*a* may be in direct, face-sharing contact with a top surface of outlet 114*b* (e.g., where a top surface of a given component is an uppermost surface in the "y" direction and a bottom surface of the given component is a lowermost surface in the "y" direction).

Figure 4:
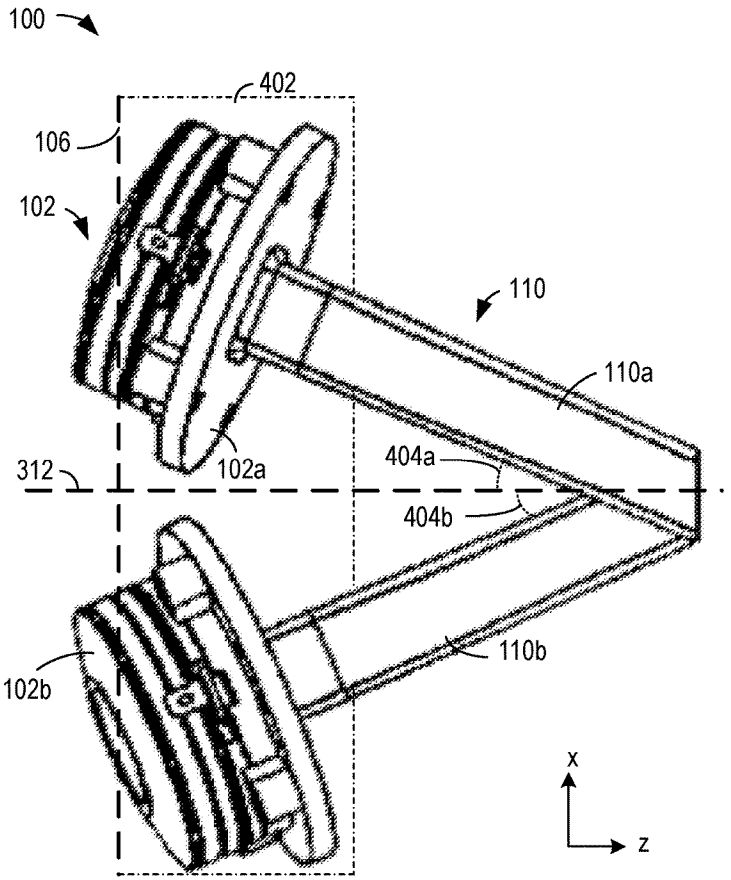
FIG. 4 shows a top view of the first example of the array of transducers in accordance with one or more embodiments of the present disclosure.

Further in the example of FIG. 1, the inlet 112 of each channel waveguide 110 is substantially aligned with another inlet along a horizontal plane (e.g., a horizontal plane extending in the "z" direction and including the horizontal axis 106) and/or a horizontal axis, where the horizontal plane/axis is perpendicular to the vertical axis 103 and/or a vertical plane or projection plane (described in more detail with respect to FIGS. 4 and 5). Accordingly, at least two inlets of the channel waveguides are substantially aligned along a horizontal plane perpendicular to the vertical axis 103 and passing through the center of the two inlets. In the illustrated example of FIG. 1, each inlet of each channel waveguide of the plurality of channel waveguides that is coupled to a transducer in the first group of transducers (e.g., in bank 104*a*) is substantially aligned along a respective horizontal plane with the inlet of an associated channel waveguide of the plurality of channel waveguides that is coupled to a transducer in the second group of transducers (e.g., in bank 104*b*), each respective horizontal plane being perpendicular to the projection plane and the vertical axis 103 and passing through the center of each pair of aligned inlets.

Each channel waveguide 110 has a length spanning from the respective inlet 112 to the respective outlet 114 of the channel waveguide. Sound produced by an associated transducer coupled to a given channel waveguide 110 travels along the length of that channel waveguide to exit the loudspeaker. As shown in FIG. 1, each channel waveguide is contoured along the length symmetrically to complement a contour of an associated channel waveguide on an opposite side of the vertical axis 103 of the loudspeaker array. Therefore, each channel waveguide on a same side of the vertical axis 103 has a substantially same contour, whereas channel waveguides on opposing sides of the vertical axis 103 have equal but opposite contours. In other words, each channel waveguide 110 on a first side of the vertical axis 103 is approximately the same as each channel waveguide on a second, opposing side of the vertical axis when the channel waveguide on the first side of the vertical axis is rotated 180 degrees around a central longitudinal axis extending from a center of the outlet 114 to a center of the inlet 112 of the channel waveguide.

The described contours may be vertical (e.g., "y" direction) contours relative to a channel waveguide length that extends straight in a "z" direction (e.g., that extends perpendicularly and/or in a straight perpendicular line relative to the vertical axis 103 along the entire length) and/or that extends at a constant angle in the "z" direction. As shown in FIG. 1, the channel waveguides do not extend in a straight perpendicular line relative to the vertical axis along the entire lengths. For example, for a given region (e.g., region 116*a*) along the length of a channel waveguide that is contoured upward on one side of the vertical axis, an associated channel waveguide on an opposing side of the vertical axis is contoured by the same amount downward at that same relative region (e.g., region 116*b*) along the length of the associated channel waveguide. In this way, a given pair of channel waveguides (either a horizontally-adjacent pair or a vertically-adjacent pair) may form a tessellation when positioned in face-sharing contact with one another such that complementary curves of the upper and lower surfaces of the channel waveguides fit with one another without any gaps.

The channel waveguides may similarly be contoured in an "x" direction to accommodate a diameter of the transducers to which the channel waveguides are coupled. In this way, each channel waveguide may be contoured in an "x" direction by an amount (relative to the center of the outlet 114 of that channel waveguide) that is a function of a diameter of an associated transducer in the array and in a direction (relative to the vertical axis 103) that is based on the position of the associated transducer. Therefore, each channel waveguide may be contoured in the "x" direction by the same amount as each other channel waveguide. Furthermore, each channel waveguide coupled to a transducer on a given side of the vertical axis may be contoured in a same direction as one another (relative to the vertical axis, where the direction is opposite of the channel waveguides coupled to transducers on an opposing side of the vertical axis).

As a result of the different entrance and exit shapes of the channel waveguides (e.g., a circular inlet and a rectangular outlet), the cross-sectional area and/or cross-sectional dimensions of the channel waveguides may vary along a length of the channel waveguides. For example, a width (in an "x" direction) of each channel waveguide may become gradually smaller along the length of the channel waveguide from the respective inlet to the respective outlet of the channel waveguide. In some examples, a height (in a "y" direction) of each channel waveguide may become gradually larger along the length of the channel waveguide from the respective inlet to the respective outlet of the channel waveguide.

A vertical length (or height) of the first bank 104*a* may be equal to a vertical length (or height) of the first bank 104*b* and to an overall length (or height) of the array 100. An overall height H (e.g., a vertical length of the banks) may be calculated by the following equation: $H=nD+(n-1)h$, where n is a total number of transducers of the plurality of transducers in the first bank, D is a diameter of each transducer of the first bank of transducers, and h is a spacing between two adjacent transducers in the first bank.

Figure 2:
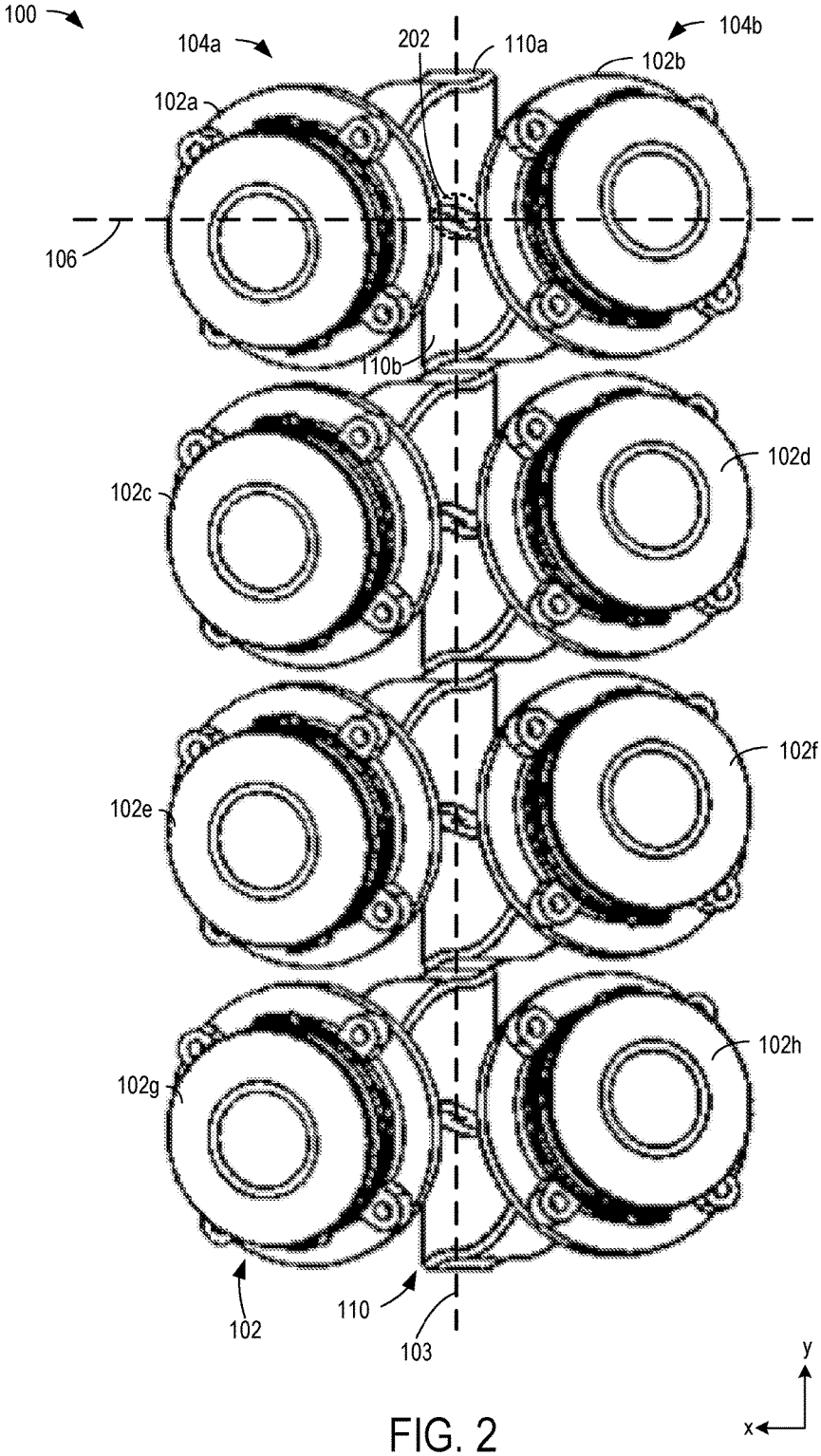
FIG. 2 shows a rear view of the first example of the array of transducers in accordance with one or more embodiments of the present disclosure.

FIG. 2 is a rear view of the example array 100 of transducers 102. As shown, the view illustrated in FIG. 2 is substantially equivalent to the view of FIG. 1 rotated 180 degrees around a center axis of the array that is parallel to or coaxial with the vertical axis 103. As shown in FIG. 2, as a result of the contoured of the channel waveguides 110, each transducer 102 may be oriented or rotated around a central horizontal axis of the transducer such that a rear of the transducers in bank 104*a* face slightly downward (toward a "−y" direction) relative to the transducers in bank 104*b*, which face slightly upward (toward a "+y" direction).

The rear view of the array shown in FIG. 2 illustrates the complementary and symmetric curvature of the channel waveguides 110. For example, region 202 (shown within a dotted circle, where the dotted circle alone does not form any structure of the array) shows a region at which the curvature of a bottom surface of waveguide 110*a* complementarily follows the curvature of a top surface of waveguide 110*b*. Similar regions are present for the remaining pairs of traducers and associated channel waveguides (e.g., the channel waveguides coupled to transducers 102*c* and 102*d*, 102*e* and 102*f*, and 102*g* and 102*h*, respectively).

Figure 3:
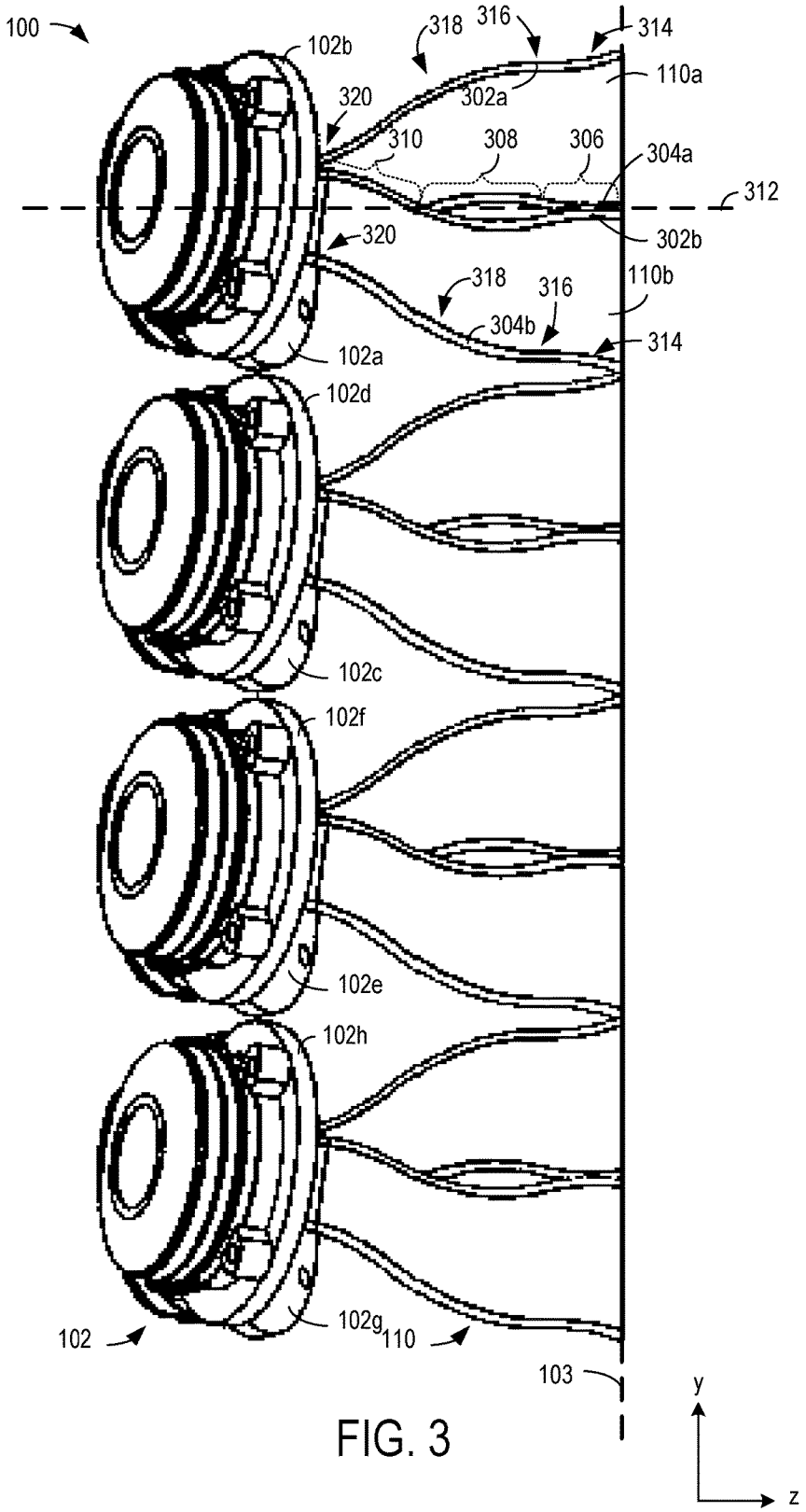
FIG. 3 shows a side view of the first example of the array of transducers in accordance with one or more embodiments of the present disclosure.

FIG. 3 shows a side view of the array 100 of transducers 102. The side view of the array shown in FIG. 3 also illustrates the complementary and symmetric curvature of the channel waveguides 110. For example, channel waveguide 110*a* is shown with a curved top surface 302*a* and a curved bottom surface 304*b* and channel waveguide 110*b* is shown with a curved top surface 302*b* and a curved bottom surface 304*b*. The bottom surface 304*a* of channel waveguide 110*a* is shown as being directly adjacent, with no gap between in the "y" direction, a top surface 302*b* of channel waveguide 110*b* in an outlet region 306 of the respective channel waveguides. Accordingly, both surfaces 304*a* and 302*b* extend substantially perpendicularly relative to the vertical axis 103 and extend substantially in parallel with one another.

In a central region 308 of the channel waveguides, the bottom surface 304*a* and top surface 302*b* are shown curving away from one another in the "y" direction, leaving a gap between the surfaces. Accordingly, while both surfaces form a semicircular arc, surface 304*a* arcs upward then downward in the "y" direction as surface 302*b* arcs downward then upward in the "y" direction. The surfaces 304*a* and 302*b* may curve by a same amount (e.g., degree or magnitude) and in opposing directions. In some examples, a central portion of region 308 may include a region of perpendicular extension of surfaces 304*a* and 302*b* (e.g., parallel to the extension in region 306) where the respective arc directions change (e.g., from upward to downward for surface 304*a* and from downward to upward for surface 302*b*; the inflection point).

In an inlet region 310 of the channel waveguides, the top surface 302*b* overlaps and is higher than the bottom surface 304*a* in the "y" direction. Accordingly, both surfaces continue the arc direction from the neighboring end of region 308, such that the bottom surface 304*a* curves downward while the top surface 302*b* curves upward in the "y" direction. The surfaces 304*a* and 302*b* may curve by the same amount in region 310 and in opposing directions, as in region 308. The degree or magnitude of curvature (relative to a depth axis 312 that extends in the "z" direction and is perpendicular to the vertical axis 103) of the bottom surface 304*a* and the top surface 302*b* may be greatest at the end of region 308 and beginning of region 310 (moving from outlet to inlet of the channel waveguides). The surfaces 304*a* and 302*b* may return to substantially perpendicular to the vertical axis 103 (and substantially parallel with one another) at the respective inlets of the channel waveguides. The surfaces 304*a* and 302*b* (as well as the channel waveguides 110*a* and 110*b* as a whole) may be mirror symmetric about the depth axis 312.

Surfaces 302*a* and 304*b* may also be mirror symmetric about the depth axis 312. For example, as shown, regions 314 of surfaces 302*a* and 304*b* exhibit an approximately equal and slight curve toward straight (e.g., perpendicular to vertical axis 103) region 316 of surfaces 302*a* and 304*b*. Top surface 302*a* curves slightly downward in the "y" direction in region 314 while bottom surface 304*b* curves slightly upward in the "y" direction in region 314. In region 318, both surfaces 302*a* and 304 exhibit a higher magnitude of curvature than in region 314, although once again in opposing directions. Top surface 302*a* curves relatively (compared to the curvature of surface 302*a* in region 314) steeply downward in the "y" direction while bottom surface 304*b* curves relatively (compared to the curvature of surfaces 304*b* in region 314) steeply upward in the "y" direction. Both surfaces 302*a* and 304*b* curve less steeply (compared to the curvature of the respective surface in region 318) and approach a straight (e.g., substantially no curvature) region 320 near the inlet of the associated transducer. In general, the surfaces 302*a* and 304*b* also curve less steeply (compared to the curvature of the respective surface in a central area of region 318) at peripheries of region 318 (e.g., near regions 320 and 316).

FIG. 4 shows a top view of the array 100 of transducers 102. An example horizontal plane 402 (e.g., as described briefly above) is illustrated as including and/or extending from horizontal axis 106. Although illustrated in FIG. 4 for clarity purposes, it is to be understood that the horizontal plane 402 may be an example of one or more of the horizontal planes described in the disclosure with reference to FIGS. 1-5. The horizontal plane 402 is shown as passing through transducers 102*a* and 102*b*, however other, parallel horizontal planes may similarly pass through the remaining horizontal pairs of transducers (e.g., transducers 102*c* and 102*d*, transducers 102*e* and 102*f*, and transducers 102*g* and 102*h*, shown in FIGS. 1, 2, 3, and 5). Each horizontal plane is perpendicular to vertical axis 103 and is perpendicular to any vertical and/or projection plane defined for the array 100.

The orientation of the array 100 in FIG. 4 illustrates the alignment of the transducers and associated channel waveguides of array 100 in the vertical direction (e.g., such that the topmost transducers obscure the view of lower transducers in the array when viewed from the top). As further shown in FIG. 4, the channel waveguides 110 are angled but not curved in the "x-z" plane (e.g., relative to the depth axis 312). The magnitudes of angle 404*a* and angle 404*b* are substantially equal (e.g., approximately 20 degrees in one example) and in opposing directions relative to depth axis 312, which extends from a center of the outlets of the channel waveguides 110 in the "z" direction. The orientation of the array 100 in FIG. 4 also shows that the horizontally-adjacent pair of transducers 102*a* and 102*b* are spaced from one another in the "x" direction (e.g., horizontally) and space by approximately equal amounts from the depth axis 312.

FIG. 5 is a projection view of the example array 100 of transducers 102. An example projection plane 502 (e.g., described briefly above) is illustrated as including and/or extending from vertical axis 103. Although illustrated in FIG. 5 for clarity purposes, it is to be understood that the projection plane 502 may be an example of one or more of the projection planes described in the disclosure with reference to FIGS. 1-5. For example, projection plane 502 may delineate sides or banks of the array. The projection plane 502 may extend in the "z" direction from the vertical axis (or around the vertical axis), and thus may be a "y-z" plane in Cartesian coordinates. The projection plane 502 may also include the depth axis 312 (illustrated in FIGS. 3 and 4).

Also illustrated in FIG. 5 is a vertical plane 504 (e.g., described briefly above) including and/or extending from vertical axis 103. Although illustrated in FIG. 5 for clarity purposes, it is to be understood that the vertical plane 504 may be an example of one or more of the vertical planes described in the disclosure with reference to FIGS. 1-5. For example, vertical plane 504 may include the plane to which the outlets of channel waveguides 110 are aligned. In this way, each channel waveguide may terminate on the same vertical plane, providing a flush vertical surface of the array.

Figure 6:
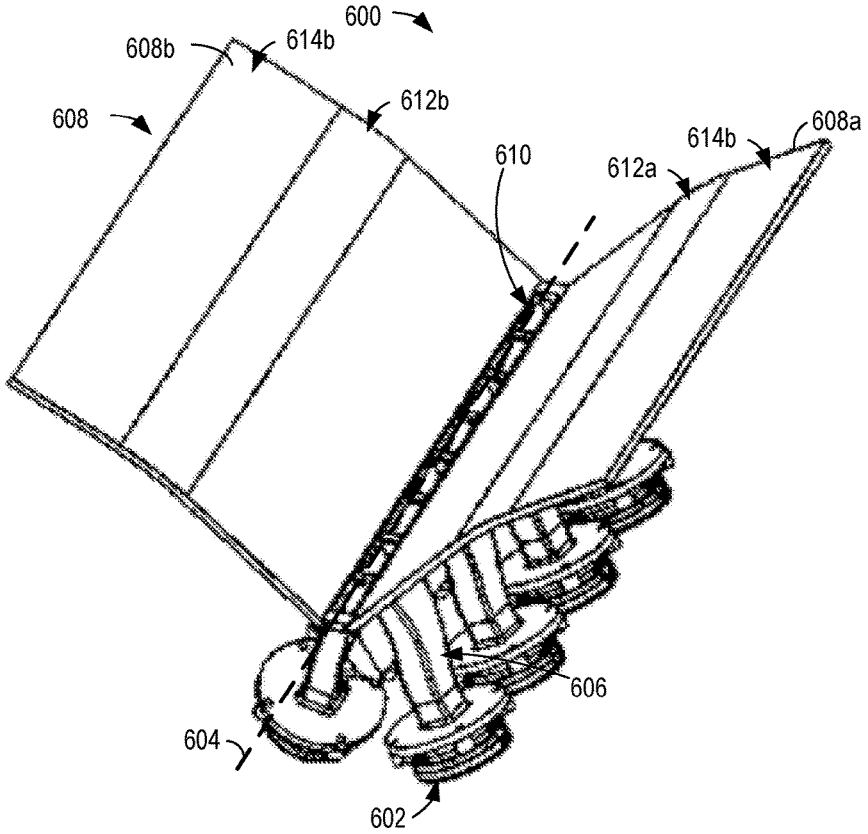
FIG. 6 shows a side isometric view of a second example of an array of transducers and outer waveguide in accordance with one or more embodiments of the present disclosure.
Figure 7:
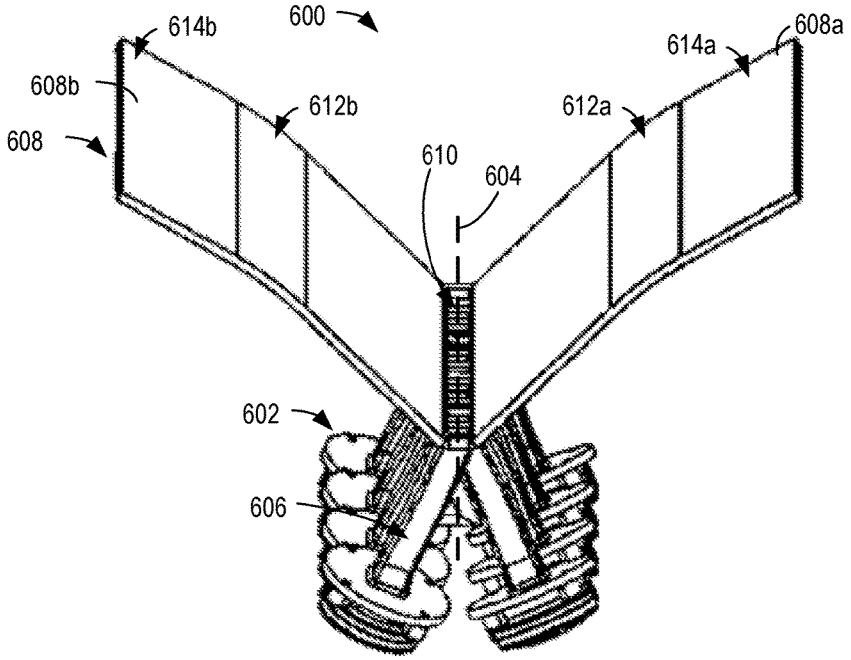
FIG. 7 shows a top isometric view of the second example of the array of transducers and outer waveguide in accordance with one or more embodiments of the present disclosure.
Figure 8:
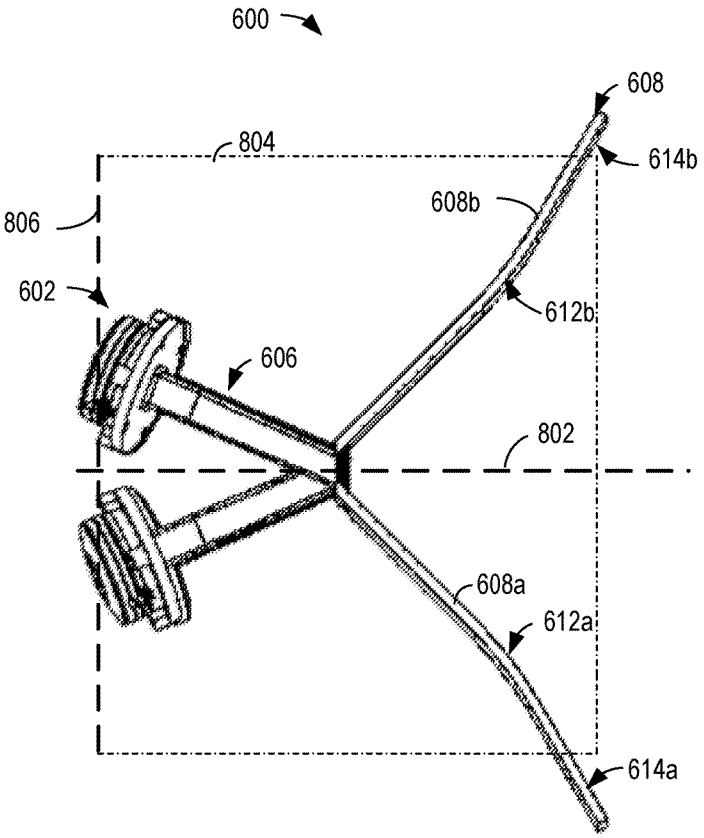
FIG. 8 shows a top view of the second example of the array of transducers and outer waveguide in accordance with one or more embodiments of the present disclosure.

FIGS. 6-8 show an example loudspeaker array 600 including a plurality of transducers 602 arranged in adjacent groups on opposing sides of a vertical axis 604 of the array, a plurality of channel waveguides 606 coupled to the transducers, and an outer waveguide 608 coupled to outlets 610 of the channel waveguides. The transducers 602 may be examples of transducers 102 of FIGS. 1-5 and channel waveguides 606 and associated outlets 610 may be examples of channel waveguides 110 and associated outlets 114 of FIGS. 1-5. Accordingly, the description of the transducers 102 and channel waveguides 110 and associated outlets 114 of FIGS. 1-5 provided above also apply to transducers 602 and channel waveguides 606 and associated outlets 610 of FIGS. 6-8. The outer waveguide 608 may include a first portion 608*a* and a second portion 608*b*, where the first portion is coupled to edges of the outlets 610 on a first side of the vertical axis 604 and the second portion is coupled to edges of the outlets 610 on a second, opposing side of the vertical axis 604.

As shown in the side perspective view of FIG. 6, as well as the bottom perspective view of FIG. 7 and the top view of FIG. 8, the first and second portions 608*a* and 608*b* may be mirror symmetric with one another about the vertical axis 604. For example, as shown in FIG. 8, each outer waveguide portion 608*a* and 608*b* may extend from the respective outlets 610 at a substantially constant angle (e.g., approximately 40-45 degrees) relative to a depth axis 802 and in opposite directions from the depth axis 802. At approximate middle regions 612*a* and 612*b* of the respective portions of the outer waveguide, the outer waveguide portions curve away from one another by an equal amount, such that the angle of the portions relative to the depth axis 802 at respective ends 614*a* and 614*b* of the portions of the outer waveguide is increased (e.g., to approximately 60 degrees). The outer waveguide 608 may provide directivity control in a horizontal plane (e.g., horizontal plane 804 of FIG. 8, which may include and/or extend from a horizontal axis 806 and be perpendicular to depth axis 802 and to vertical axis 604 of FIGS. 6 and 7).

Figure 10:
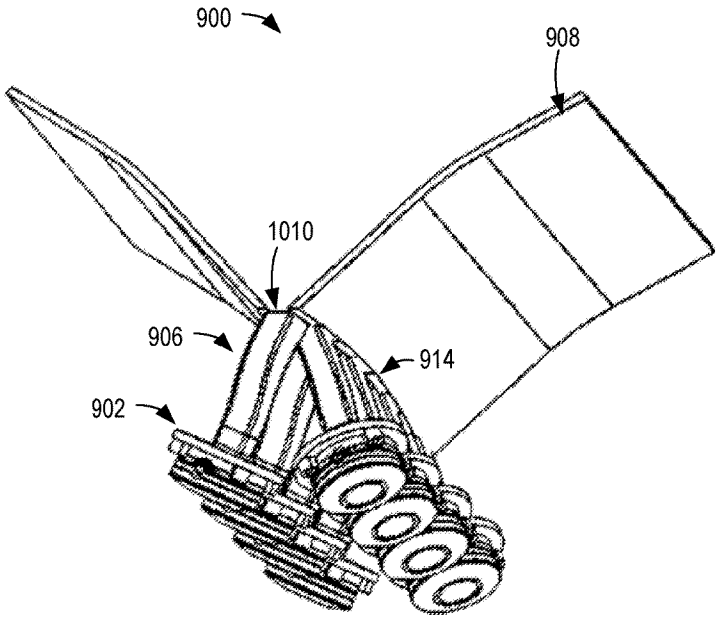
FIG. 10 shows a top isometric view of the third example of the array of transducers and curved outer waveguide in accordance with one or more embodiments of the present disclosure.
Figure 9:
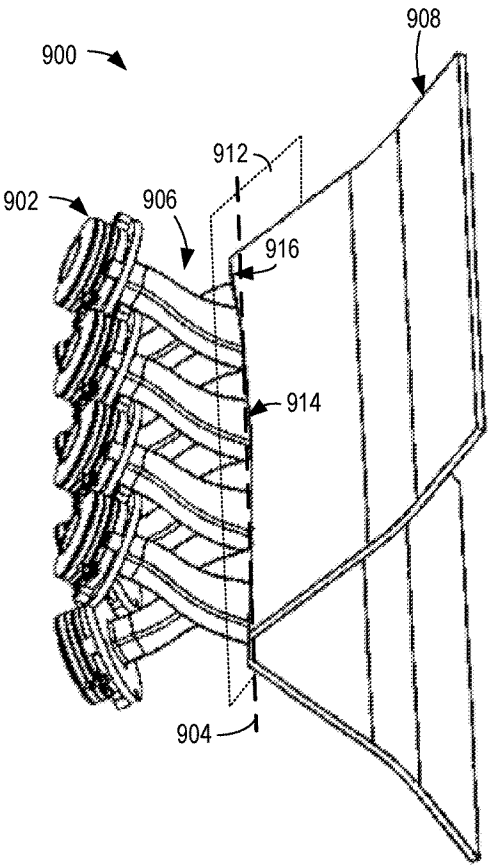
FIG. 9 shows a side isometric view of a third example of an array of transducers and curved outer waveguide in accordance with one or more embodiments of the present disclosure.

FIGS. 9 and 10 show a side perspective view and a bottom perspective view, respectively, of an example loudspeaker array 900. The loudspeaker array 900 includes a plurality of transducers 902 arranged in adjacent groups on opposing sides of a vertical axis 904 of the array, a plurality of channel waveguides 906 coupled to the transducers, and an outer waveguide 908 coupled to outlets 1010 (shown in FIG. 10) of the channel waveguides. The transducers 902 may be examples of transducers 102 of FIGS. 1-5 and/or transducers 602 of FIGS. 6-8. The channel waveguides 906 and associated outlets 1010 may be examples of channel waveguides 110 and associated outlets 114 of FIGS. 1-5 and/or channel waveguides 606 and associated outlets 610 of FIGS. 6-8. The outer waveguide 908 may be an example of outer waveguide 608 of FIGS. 6-8. Accordingly, at least some of the description of the transducers 102/602, channel waveguides 110/606 and associated outlets 114/610 of FIGS. 1-5 and 6-8 and at least some of the description of outer waveguide 608 of FIGS. 6-8 provided above also apply to transducers 902, channel waveguides 906 and associated outlets 1010, and outer waveguide 908 of FIGS. 9 and 10.

A difference in array 900 relative to the previously-described arrays (e.g., array 100 of FIGS. 1-5 and array 600 of FIGS. 6-8) is that array 900 is curved in a vertical plane 912 that is parallel to and/or includes the vertical axis 904. The curved convex profile is shown at 914 in FIGS. 9 and 10. As shown at 916, a base of the outer waveguide 908 (and thereby associated outlets of the channel waveguides coupled to the outer waveguide in that region) deviates from vertical axis and thus the outlets are not aligned on the same vertical plane. Vertical directivity is controlled, as the curved profile introduces a progressively increasing time delay in peripheral transducers (e.g., sound output from the peripheral transducers travels farther to a common location in the environment relative to sound output from central transducers), and therefore widens the vertical directivity response.

Figure 11:
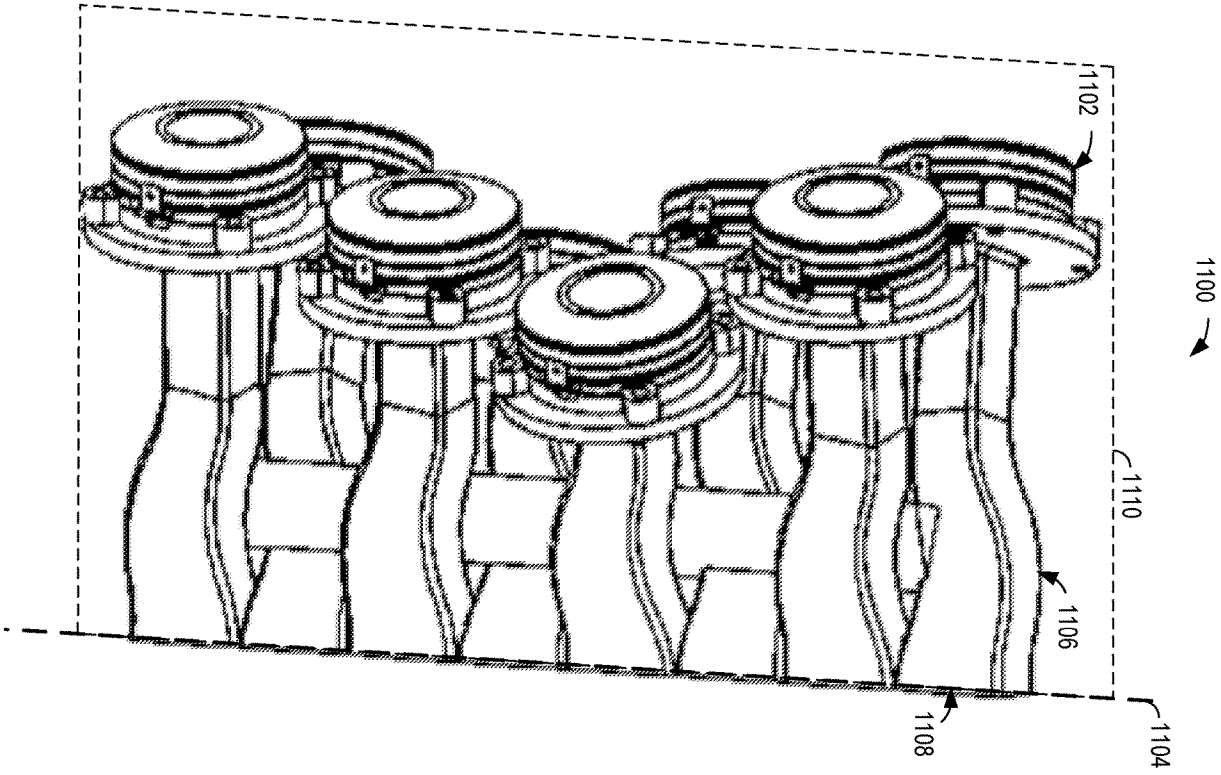
FIG. 11 shows a side view of a fourth example of an array of transducers in accordance with one or more embodiments of the present disclosure.
Figure 12:
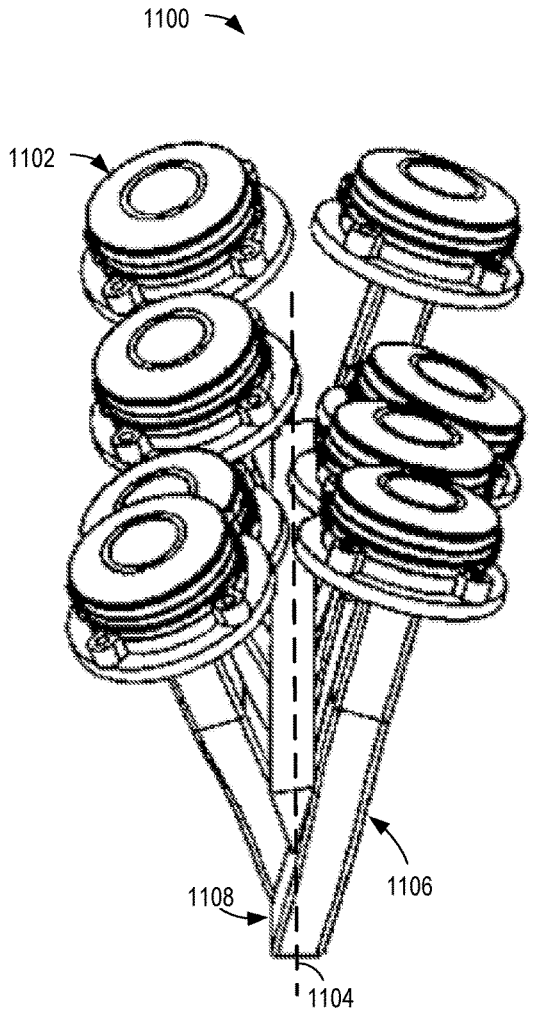
FIG. 12 shows a top isometric view of the fourth example of the array of transducers in accordance with one or more embodiments of the present disclosure.
Figure 13:
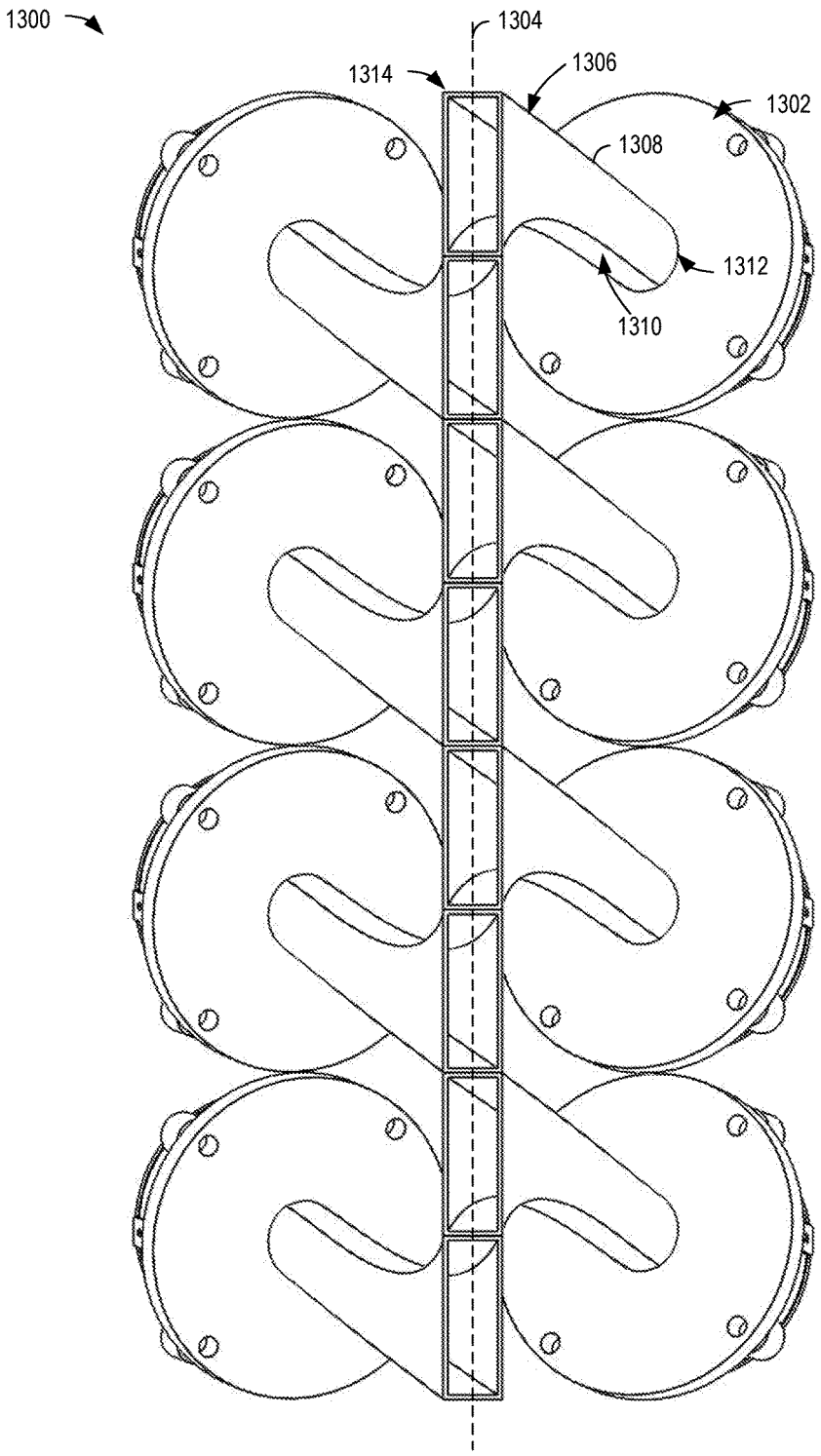
FIG. 13 shows a front view of a fifth example of an array of transducers in accordance with one or more embodiments of the present disclosure.
Figure 14:
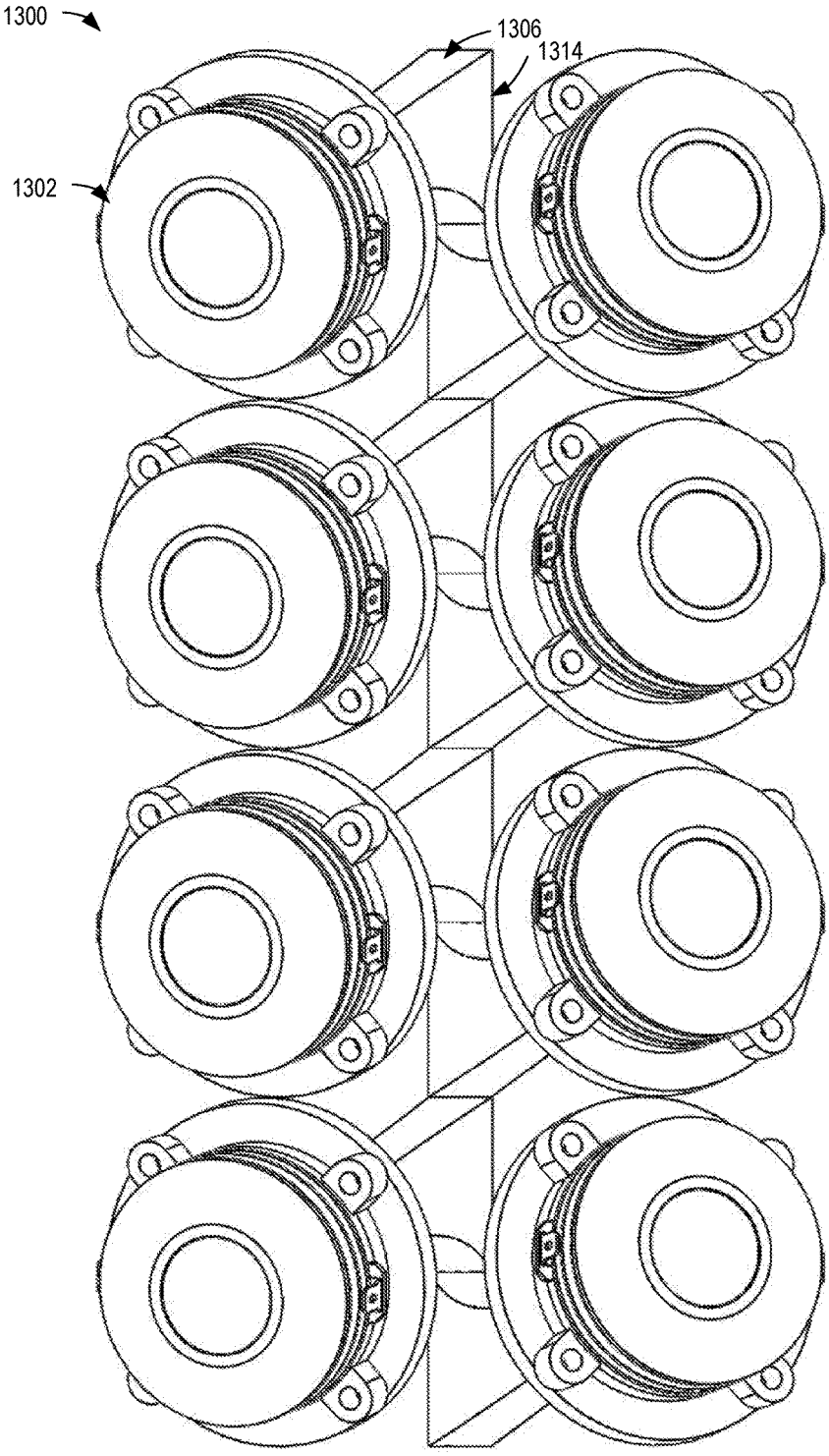
FIG. 14 shows a rear view of the fifth example of the array of transducers in accordance with one or more embodiments of the present disclosure.

FIGS. 11 and 12 show a side perspective view and a top perspective view, respectively, of an example loudspeaker array 1100. The loudspeaker array 1100 includes a plurality of transducers 1102 arranged in adjacent groups on opposing sides of a vertical axis 1104 of the array, a plurality of channel waveguides 1106 coupled to the transducers. The transducers 1102 may be examples of transducers 102 of FIGS. 1-5, transducers 602 of FIGS. 6-8, and/or transducers 902 of FIGS. 9 and 10. The channel waveguides 1106 may be examples of channel waveguides 110 of FIGS. 1-5, channel waveguides 606 of FIGS. 6-8, and/or channel waveguides 906 of FIGS. 9 and 10. Accordingly, at least some of the description of the transducers 102/602/902 and channel waveguides 110/606/906 of FIGS. 1-5, 6-8, and 9-10, respectively, provided above also apply to transducers 1102 and channel waveguides 1106 of FIGS. 11 and 12.

A difference between array 1100 and arrays 100, 600, and 900 is that array 1100 includes channel waveguides that have different lengths from one another (e.g., where the length of a channel waveguide is a distance between an inlet and an outlet of the channel waveguide across which sound generated by an associated transducer travels). Array 1100 includes a flat front (e.g., each outlet 1108 of each channel waveguide 1106 is aligned on a vertical plane extending from and/or including vertical axis 1104, as described with respect to outlets 114 of FIGS. 3-5), and a progressive extension of channel waveguides widens the directivity response in the vertical plane. For example, the lengths of the channel waveguides may be increased as a function of a distance from a center of the array (e.g., a center of an overall length of the array in a direction parallel to the vertical axis 1104), where channel waveguides that are farther from the center of the array are longer than channel waveguides that are closer to the center of the array. Different lengths of the channel waveguides cause a difference in acoustical impedance and sound pressure transfer functions. Accordingly, in the example of FIGS. 11 and 12, the length of at least one channel waveguide is different than the length of at least one other channel waveguide of the array. In other examples, acoustical impedance and sound pressure transfer functions may be controlled (or further controlled) using digital signal processing.

FIG. 11 shows an optional housing (e.g., cabinet or enclosure) 1110 representing a structure in which the array 1100 may be housed. As shown, at least one of the transducers 1102 is positioned at a different depth within the housing 1110 (from the vertical axis 1104 and/or a vertical plane formed therefrom) relative to at least another of the transducers 1102. In contrast, in the arrays 100, 600, and 900, the associated transducers (when included in a similar housing to that illustrated in FIG. 11) would all have the same depth within the housing from an associated vertical axis/plane.

Figure 18:
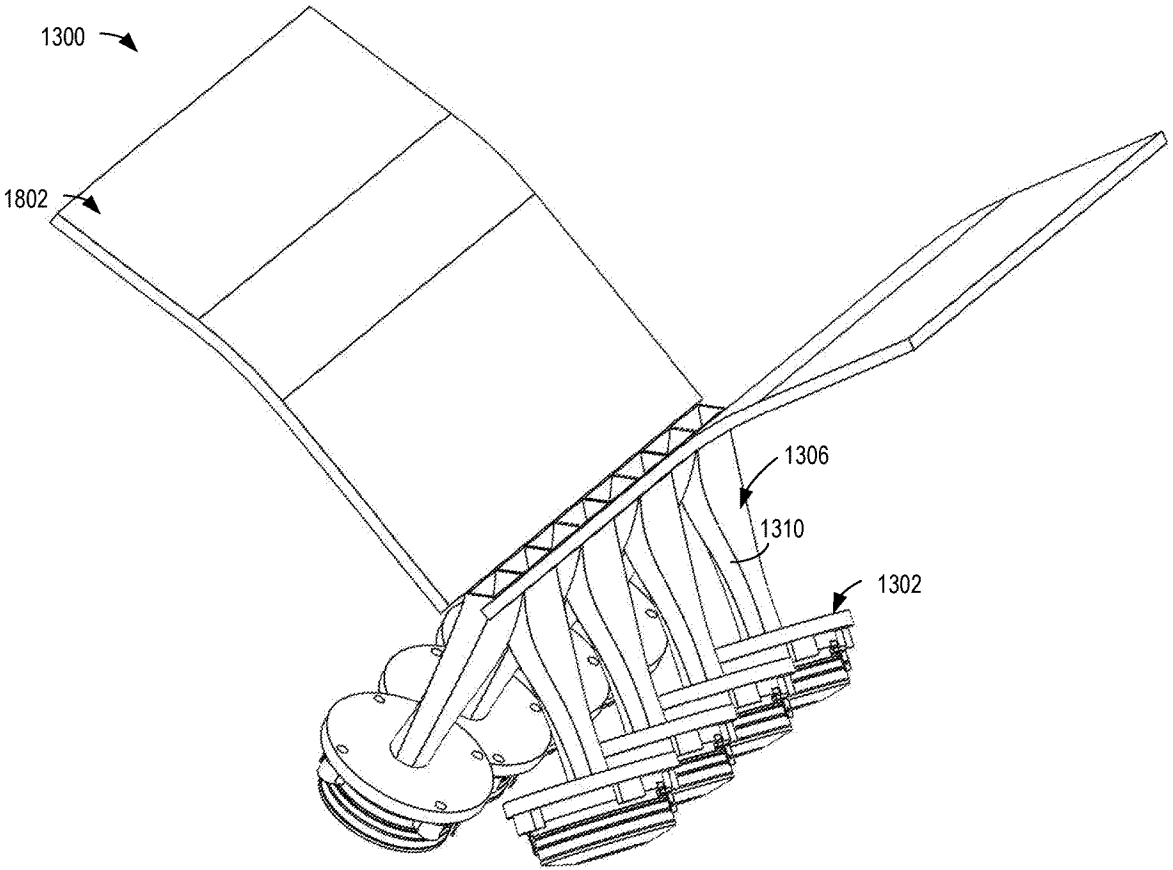
FIG. 18 shows a side isometric view of the fifth example of the array of transducers with an optional outer waveguide in accordance with one or more embodiments of the present disclosure.

FIGS. 13-18 show different views of an example loudspeaker array 1300. The loudspeaker array 1300 includes a plurality of transducers 1302 arranged in adjacent groups on opposing sides of a vertical axis 1304 of the array and a plurality of channel waveguides 1306 coupled to the transducers. The transducers 1302 may be examples of transducers 102 of FIGS. 1-5, transducers 602 of FIGS. 6-8, transducers 902 of FIGS. 9 and 10, and/or transducers 1102 of FIGS. 11 and 12. The channel waveguides 1306 may be examples of channel waveguides 110 of FIGS. 1-5, channel waveguides 606 of FIGS. 6-8, channel waveguides 906 of FIGS. 9 and 10, and/or channel waveguides 1106 of FIGS. 11 and 12. Accordingly, at least some of the description of the transducers 102/602/902/1102 and channel waveguides 110/606/906/1106 of FIGS. 1-5, 6-8, 9-10, and 11-12 respectively, provided above also applies to transducers 1302 and channel waveguides 1306 of FIGS. 13-18. FIG. 18 also shows an optional outer waveguide 1802 coupled to the outlets of the plurality of channel waveguides 1302. The outer waveguide 1802 may provide directivity control in a horizontal plane, as described above with reference to the outer waveguide 608 of FIG. 6 and/or the outer waveguide 908 of FIG. 9.

Figure 15:
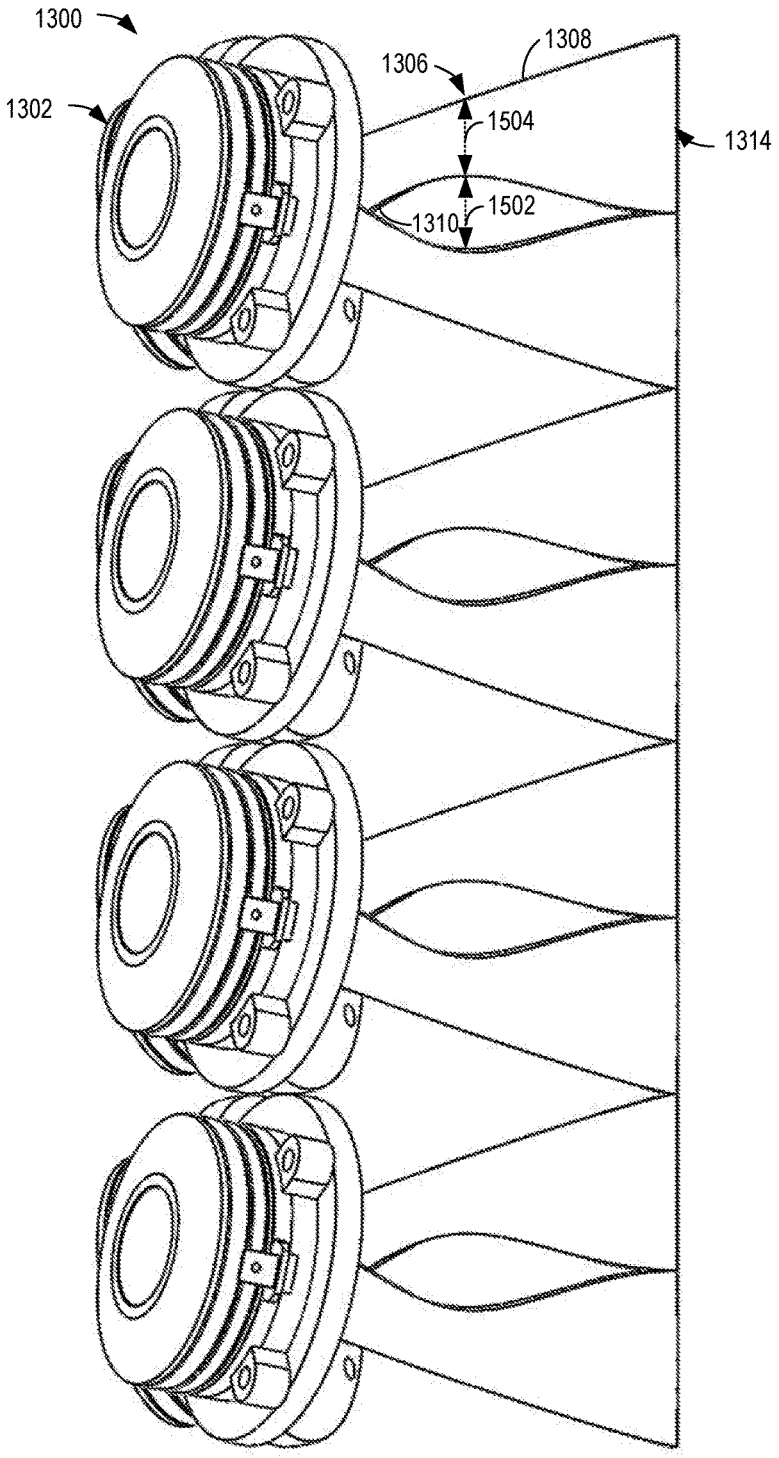
FIG. 15 shows a side view of the fifth example of the array of transducers in accordance with one or more embodiments of the present disclosure.

A difference between array 1300 and arrays 100, 600, 900, and 1100 is that array 1300 includes channel waveguides that are curved in a different manner than the channel waveguides of the previously-described arrays. For example, each channel waveguide 1306 of the array 1300 may include a first surface 1308 that is substantially flat along a length from an inlet 1312 to an outlet 1314 of that channel waveguide (at least in some examples, the first surface 1308 may be sloped, and as such the first surface being substantially flat may include the first surface sloping linearly along an entirety of the length of the first surface). Each channel waveguide 1306 of the array 1300 may further include a second surface 1310, opposite from the first surface 1308 that is substantially curved along at least a portion of the length from the inlet 1312 to the outlet 1314 of that channel waveguide. For example, the second surface 1310 may be substantially flat or linearly sloped in a first portion extending from the inlet 1312, and substantially curved in a second portion extending between the first portion and the outlet 1314). It is to be understood that the features of the channel waveguides 1306 are common to each channel waveguide of the array, however the orientation of the channel waveguides coupled to transducers on a first side of the longitudinal axis of the array may be mirrored relative to the channel waveguides coupled to transducers on a second, opposing side of the longitudinal axis of the array. As shown in FIG. 15, the curvature of the second surface may create a distance 1502 between second surfaces of adjacent channel waveguides that is greater, at an apex region (the region at which distance 1502 is measured in FIG. 15), than the distance between the first and second surfaces of either of the adjacent channel waveguides (e.g., distance 1504 of a top channel waveguide).

Figure 16:
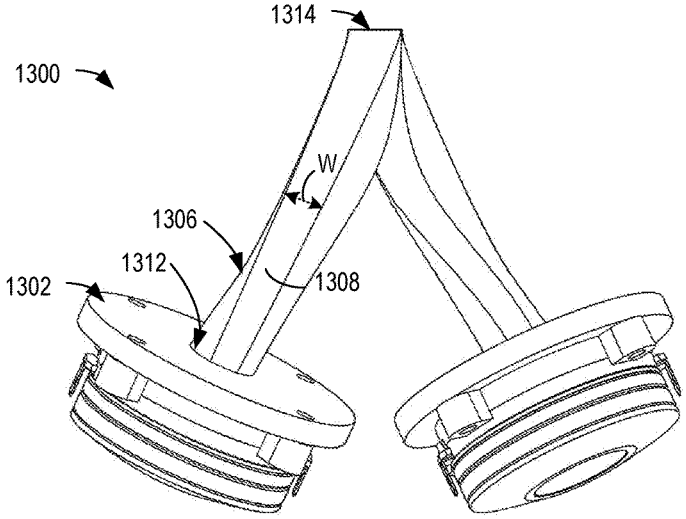
FIG. 16 shows a top view of the fifth example of the array of transducers in accordance with one or more embodiments of the present disclosure.
Figure 17:
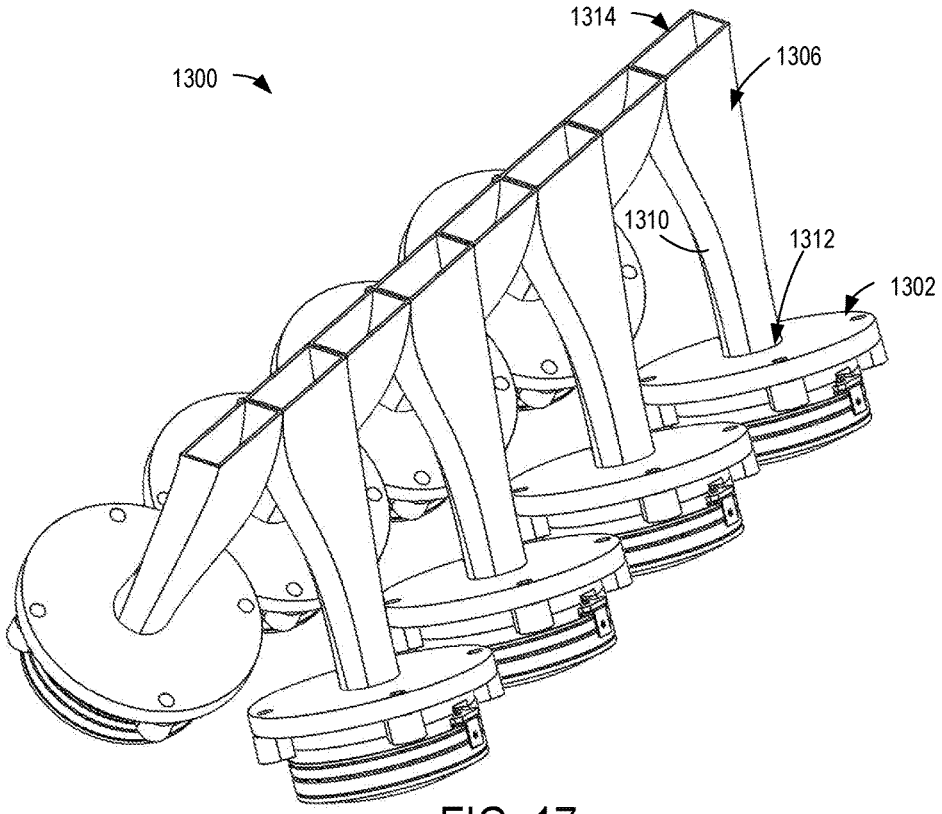
FIG. 17 shows an isometric view of the fifth example of the array of transducers in accordance with one or more embodiments of the present disclosure.

The channel waveguides 1306 may begin with a circular entrance and end with a rectangular exit. Accordingly, the profile of each channel waveguides may not be constant and may expand or contract from the entrance to the exit, at least in order to accommodate the difference in shape between the entrance and the exit. For example, as shown in FIG. 16, a width W of the first surface 1308 of each of the channel waveguides 1306 may taper linearly along the length of the channel waveguide, the width W being largest at a terminating end of the first surface closest to the outlet 1314 and smallest at an opposing terminating end of the first surface closest to the inlet 1312. A corresponding width of the second surface may be substantially the same along the length of the channel waveguide (e.g., the width of the second surface may not change along the length of the channel waveguide). In other examples, the profile of one or more surfaces of the channel waveguides may be or appear constant in width.

In general, a central axis of each channel waveguide that is equidistant from the walls inside the channel waveguide in horizontal and vertical planes is arranged for the mutual positions of the channel waveguides (e.g., to accommodate an adjacent channel waveguide), but the particular shape of the walls of the channel waveguides provide a symmetric directivity pattern in the vertical plane. The symmetry of directivity response in the horizontal plane of the array is provided by the symmetric mirror mutual position of the adjacent waveguides.

The curvature of the channel waveguides 1306 provides improvement in a symmetry of vertical directivity of individual waveguides relative to other waveguide configurations. Further, the shape of the channel waveguides 1306 provides a better orientation of the wavefront at the exit of the waveguide relative to other waveguide configurations. The above-described advantages are achieved since the lengths of the waveguide profile (e.g., "vertical walls") are closer to each other compared to other waveguide configurations.

The loudspeaker arrays illustrated in FIGS. 1-18 include multiple waveguide-loaded transducers coupled to curved channel waveguides that have a mutual orientation. The arrays may be included in any suitable loudspeaker systems, including touring sound systems, cinema sound systems, installed loudspeaker systems including in-wall applications, and constant beamwidth transducer (CBT) arrays. The curved channel waveguides may be curved in the vertical plane and directed at a symmetric angle to a horizontal axis of the array, resulting in adjacent pairs of transducers that are aligned horizontally while outlets of associated channel waveguides are aligned vertically. A technical effect of these curved channel waveguides is that the waveguides enable the construction of arrays having a shorter overall length than other arrays with the same number of transducers and same vertical dimension of radiating elements. Shorter overall array length may also be effective in tapered cabinets where other configurations of transducers would result in fewer transducers fitting in the cabinet (thereby reducing a spatial resolution in the vertical plane and reducing a maximum sound pressure level). Another technical effect is provided by an array with a curved front profile and/or an array with channel waveguides having different lengths in order to widen an associated vertical directivity pattern. In each of the described examples, the V-shape orientation of the adjacent channel waveguides also provides a radiation pattern that is symmetrical in the horizontal plane, providing a technical effect of a balanced listening experience.

FIGS. 1-18 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. For example, two transducers may be referred to as being adjacent to one another when there is no other transducer between the two transducers (e.g., in at least one direction). As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The description of embodiments has been presented for purposes of illustration and description. Suitable modifications and variations to the embodiments may be performed in light of the above description or may be acquired from practicing the methods. The described systems are exemplary in nature, and may include additional elements and/or omit elements. The subject matter of the present disclosure includes all novel and non-obvious combinations and subcombinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

The invention claimed is:

1. A loudspeaker array, comprising:

a plurality of transducers arranged in adjacent groups on opposing sides of a vertical axis of the loudspeaker array; and a plurality of channel waveguides, each channel waveguide coupled to a different transducer of the plurality of transducers, outlets of each channel waveguide being center aligned with one another along the vertical axis of the loudspeaker array, wherein at least a first inlet of the plurality of channel waveguides and a second inlet of the plurality of channel waveguides are substantially aligned along a horizontal plane, the horizontal plane being perpendicular to the vertical axis, and wherein a first longitudinal axis of a first channel waveguide extending from the first inlet to an associated first outlet of the first channel waveguide and a second longitudinal axis of a second channel waveguide extending from the second inlet to an associated second outlet of the second channel waveguide are at a constant angle relative to one another in the horizontal plane.

2. The loudspeaker array of claim 1, wherein a vertical length of a first bank including a first group of transducers on a first side of the vertical axis is calculated by summing n*D and [(n−1)*h], where n is a total number of transducers of the plurality of transducers in the first bank, D is a diameter of each transducer of the first bank of transducers, h is a spacing between two adjacent transducers in the first bank, and wherein a vertical length of a second bank including a second group of transducers on a second side of the vertical axis and an overall vertical length of the loudspeaker array is equal to the vertical length of the first bank.

3. The loudspeaker array of claim 1, wherein each channel waveguide of the plurality of channel waveguides is curved along a length of the channel waveguide between a respective inlet and a respective outlet of the channel waveguide.

4. The loudspeaker array of claim 3, wherein a curvature of each channel waveguide coupled to a transducer of a first group of transducers on a first side of the vertical axis is equal and opposite to a curvature of each channel waveguide coupled to a transducer of a second group of transducers on a second, opposite side of the vertical axis.

5. The loudspeaker array of claim 3, wherein each channel waveguide of the plurality of channel waveguides is contoured symmetrically to complement an associated channel waveguide on an opposite side of the vertical axis of the loudspeaker array, and wherein the first longitudinal axis of the first channel waveguide is at a same angle relative to a depth axis of the loudspeaker array as the second longitudinal axis of the second channel waveguide, the depth axis extending from a center of an outlet of the plurality of channel waveguides, the depth axis being perpendicular to the vertical axis and the horizontal plane.

6. The loudspeaker array of claim 1, wherein each channel waveguide has an equal length from an inlet of the channel waveguide to the outlet of the channel waveguide.

7. The loudspeaker array of claim 1, wherein each channel waveguide has a length from an inlet of the channel waveguide to the outlet of the channel waveguide, and wherein the length of at least one channel waveguide is different than the length of at least one other channel waveguide of the plurality of channel waveguides.

8. The loudspeaker array of claim 7, wherein each outlet of each channel waveguide is positioned along a same vertical plane that includes the vertical axis of the loudspeaker array.

9. The loudspeaker array of claim 8, further comprising a housing in which the plurality of transducers and the plurality of channel waveguides are positioned, and wherein at least a first transducer coupled to the at least one channel waveguide is positioned at a different depth within the housing from the vertical plane relative to at least a second transducer coupled to the at least one other channel waveguide of the plurality of channel waveguides.

10. The loudspeaker array of claim 1, further comprising an outer waveguide coupled to the outlets of the plurality of channel waveguides to provide directivity control of output sound in the horizontal plane.

11. The loudspeaker array of claim 1, wherein the loudspeaker array is curved in a vertical plane parallel to the vertical axis, widening vertical directivity response by introducing progressively increasing time delay in sound output by peripheral transducers of the plurality of transducers relative to central transducers of the plurality of transducers.

12. A loudspeaker array, comprising:

a plurality of transducers including a first group of transducers positioned on a first side of a projection plane of the loudspeaker array and a second group of transducers positioned on a second, opposing side of the projection plane, the projection plane including a vertical axis of the loudspeaker array;

a plurality of curved channel waveguides, each channel waveguide coupled to a different transducer of the plurality of transducers at an inlet of the channel waveguide, an outlet of each channel waveguide having a center positioned on the projection plane of the loudspeaker array; and an outer waveguide coupled to the outlets of the plurality of channel waveguides, wherein each inlet of each channel waveguide of the plurality of channel waveguides that is coupled to a transducer in the first group of transducers is substantially aligned along a respective horizontal plane with the inlet of an associated channel waveguide of the plurality of channel waveguides that is coupled to a transducer in the second group of transducers, each respective horizontal plane being perpendicular to the projection plane and the vertical axis, and wherein the plurality of curved channel waveguides includes a first channel waveguide coupled to a first transducer in the first group of transducers and a second channel waveguide coupled to a second transducer in the second group of transducers, a first outlet of the first channel waveguide being adjacent to a second outlet of the second channel waveguide, and a first distance between a bottom surface of the first channel waveguide and a top surface of the second channel waveguide at an apex region being greater than a second distance between the bottom surface of the first channel waveguide and an opposing top surface of the first channel waveguide at at least one region along a length of the first channel waveguide.

13. The loudspeaker array of claim 12, wherein a curvature of each channel waveguide on the first side of the projection plane is symmetrically complementary to a curvature of an associated channel waveguide on the second, opposing side of the projection plane.

14. The loudspeaker array of claim 12, wherein the loudspeaker array is curved in the projection plane with the outlets of the plurality of channel waveguides positioned at different depths of the projection plane.

15. The loudspeaker array of claim 12, wherein depths of the outlets of the plurality of channel waveguides are mirror symmetric relative to a central horizontal plane of the loudspeaker array, the central horizontal plane being perpendicular to the projection plane.

16. The loudspeaker array of claim 15, wherein the central horizontal plane is positioned at a center of an overall length of the loudspeaker array, the overall length calculated by summing n*D and [(n−1)*h], where n is a total number of transducers of the first group, D is a diameter of each transducer of the first group, and h is a spacing between two adjacent transducers in the first group.

17. A loudspeaker array, comprising:

a plurality of transducers arranged in adjacent groups on opposing sides of a vertical axis of the loudspeaker array; and a plurality of channel waveguides, each channel waveguide coupled to a different transducer of the plurality of transducers and each channel waveguide having a length along which sound produced by an associated transducer of the plurality of transducers travels, each channel waveguide having a different associated outlet, the outlet of each channel waveguide being center aligned along the vertical axis of the loudspeaker array, the length of each channel waveguide extending from a respective associated transducer of the plurality of transducers to the respective outlet of the channel waveguide, wherein each channel waveguide of the plurality of channel waveguides is contoured along the length symmetrically to complement a contour of an associated channel waveguide on an opposite side of the vertical axis of the loudspeaker array, and wherein the length of at least one channel waveguide of the plurality of waveguides is different than the length of at least one other channel waveguide of the plurality of channel waveguides.

18. The loudspeaker array of claim 17, further comprising an outer waveguide coupled to the outlets of the plurality of channel waveguides.

19. The loudspeaker array of claim 17, wherein a curvature of each channel waveguide coupled to a transducer of a first group of transducers on a first side of the vertical axis is equal and opposite to a curvature of each channel waveguide coupled to a transducer of a second group of transducers on a second, opposite side of the vertical axis.

20. The loudspeaker array of claim 17, wherein the outlet of each channel waveguide is a same size as one another.

* * * * *